United States Patent [19]

Maruyama et al.

[11] Patent Number: 5,046,517

[45] Date of Patent: Sep. 10, 1991

[54] DISHWASHING MACHINE

[75] Inventors: Fumio Maruyama, Nagoya; Osamu Nagata; Tomio Suyama, both of Toyoake; Yukimasa Takeda, Nagoya; Hiroaki Kamino, Toyoake; Koji Suyama, Shimane, all of Japan

[73] Assignee: Hoshizaki Denki Kabushiki Kaisha, Toyoake, Japan

[21] Appl. No.: 574,018

[22] Filed: Aug. 29, 1990

[30] Foreign Application Priority Data

Aug. 31, 1989 [JP] Japan ..... 1-225296

[51] Int. Cl.[5] ..... A47L 15/42

[52] U.S. Cl. ..... 134/95; 134/96; 134/99; 134/103; 134/111

[58] Field of Search ..... 134/95, 96, 99, 103, 134/111

[56] References Cited

U.S. PATENT DOCUMENTS

| | | | |
|---|---|---|---|
| 1,670,611 | 5/1928 | Couch | 134/96 X |
| 2,508,999 | 5/1950 | Hirsch | 134/96 |
| 2,575,493 | 11/1951 | Hilliker | 134/96 |
| 2,698,628 | 1/1955 | Zademach et al. | 134/96 X |
| 3,020,917 | 2/1962 | Lyman | 134/111 X |
| 3,070,104 | 12/1962 | Faust et al. | 134/111 X |
| 3,587,597 | 6/1971 | Courtney et al. | 134/96 X |

FOREIGN PATENT DOCUMENTS

| | | | |
|---|---|---|---|
| 1270239 | 6/1968 | Fed. Rep. of Germany | 134/96 |

*Primary Examiner*—Philip R. Coe

*Attorney, Agent, or Firm*—Armstrong, Nikaido, Marmelstein, Kubovcik, & Murray

[57] ABSTRACT

A dishwashing machine having a washing chamber, a wash tank provided at a bottom of the washing chamber to store an amount of hot wash water therein, a wash pump mounted to a bottom portion of the tank to pump up the wash water therefrom, a pair of wash arms supplied with the wash water by the wash pump, a rinse pump arranged to pump up fresh hot water supplied thereto from a source of hot water, and a pair of rinse arms supplied with the fresh hot water by the rinse pump, a drain box arranged within an upper portion of the tank and associated with a side wall of the tank to form an opening in communication with the bottom portion of the tank, a drain pipe connected to a bottom wall of the drain box and being extended outwardly through the bottom wall of the tank to drain the wash water received by the drain box, an overflow pipe secured to the bottom wall of the drain box to permit the upward flow of wash water from the bottom of the tank, and a tiltable plate arranged above the drain box to introduce the wash water flowing down from the washing chamber into the drain box when placed in a first position in prewashing operation and to introduce the wash water or fresh hot water into the bottom portion of the tank when placed in a second position in washing and rinsing operation.

3 Claims, 10 Drawing Sheets

DISHWASHING MACHINE

BACKGROUND OF THE INVENTION

1. Field of the Invention

The present invention relates to a dishwashing machine, and more particularly to an improvement of a dishwashing machine wherein the racked dishes are washed and rinsed by spray of hot water.

2. Discussion of the Prior Art

In conventional dishwashing machines of the commercial spray-type, hot wash water is drawn from a wash tank at the bottom of the washing chamber and supplied to upper and lower wash arms in the washing chamber by means of a circulation pump mounted to the wash tank. The hot wash water is sprayed by rotation of the wash arms over the racked dishes in the washing chamber and is circulated into the wash tank. Subsequently, fresh hot rinse water is further supplied to the wash arms and sprayed over the racked dishes therefrom. The hot rinse water is also circulated into the wash tank, and the rinse water excess in amount is drained through an overflow pipe in the wash tank. In conventional dishwashing machines of the household type, hot wash water is drawn from a wash tank at the bottom of the washing chamber and supplied to upper and lower wash arms in the washing chamber by means of a circulation pump mounted to the wash tank. After sprayed over the racked dishes in the washing chamber, the hot wash water is circulated into and drained from the wash tank. Subsequently, fresh hot rinse water is supplied into the wash tank and is pumped up from the wash tank to the wash arms by means of the circulation pump. After sprayed over the racked dishes, the hot rinse water is circulated into the wash tank.

In the dishwashing machine of the commercial spray-type, the hot wash water is contaminated by food soils and cooking oil released from the dishes at an initial stage of the washing operation and circulated into the wash tank. With the contaminated wash water, the food soils of the dishes become difficult to remove. Assuming that glasses have been placed in the washing chamber after washing of dishes soiled with curry, the glasses will be soiled with the contaminated wash water. At the initial stage of the washing operation, the dishes absorb the heat of wash water sprayed thereon to cause fall of the temperature of wash water circulated into the wash tank. As a result, the hot wash water may not be maintained at a proper temperature required for sanitarily washing the dishes. In the dishwashing machines of the household type, the contamination of the hot water can be avoided but the temperature of hot water in the wash tank falls below the proper temperature.

SUMMARY OF THE INVENTION

It is, therefore, a primary object of the present invention to provide an improved dishwashing machine wherein the contamination of wash and rinse hot water can be minimized without causing the temperature fall of wash and rinse water.

According to the present invention, the object is attained by providing a dishwashing machine which includes a washing chamber having a bottom, a vertical wash tank provided at the bottom of the washing chamber to stroe an amount of hot wash water therein, a wash pump mounted to a bottom portion of the wash tank to pump up the wash water therefrom, first spray means for applying jest streams of the wash water supplied thereto from the wash pump over a rack of dishes placed in the washing chamber, a rinse pump arranged to pump up fresh hot water supplied thereto from a source of hot water, and second spray means for applying jet streams of the fresh hot water supplied thereto from the rinse pump over the rack of dishes.

The dishwashing machine comprises a drain box arranged within an upper portion of the wash tank to receive the wash water flowing down from the rack of dishes and associated with a side wall of the wash tank to form an opening in communication with the bottom portion of the wash tank, an upstanding drain pipe connected to a bottom wall of the drain box and being extended outwardly through the bottom wall of the wash tank to drain therethrough the wash water received by the drain box, an upstanding overflow pipe secured at its intermediate portion to the bottom wall of the drain box to permit the upward flow of wash water from the bottom of the wash tank into the drain box, the overflow pipe extending upward into the interior of the drain box in a predetermined distance to define the level of wash water stored in the wash tank, a tiltable plate arranged above the drain box to introduce the wash water flowing down from the rack of dishes into the drain box when placed in a first position and to introduce the wash water and fresh hot water flowing down from the rack of dishes into the bottom portion of the wash tank through the opening when placed in a second position, and a drive mechanism for placing the tiltable plate in the first position when the rack of dishes is prewashed by jet streams of the wash water applied from the first spray means and for placing the tiltable plate in the second position when the rack of dishes is washed by jet streams of the wash water applied from the first spray means after prewashing operation and is rinsed by jet streams of the fresh hot water applied from the second spray means.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
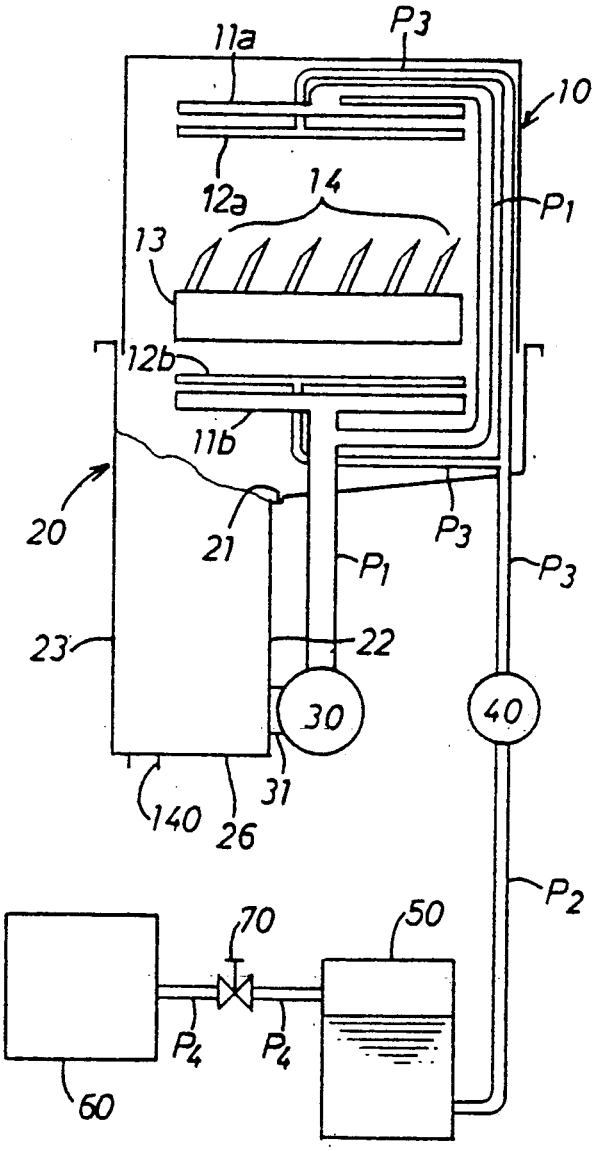
FIG. 1 is a partly broken schematic illustration of a dishwashing machine of the commercial spray-type incorporating the preferred embodiment of the present invention.
Figure 3:
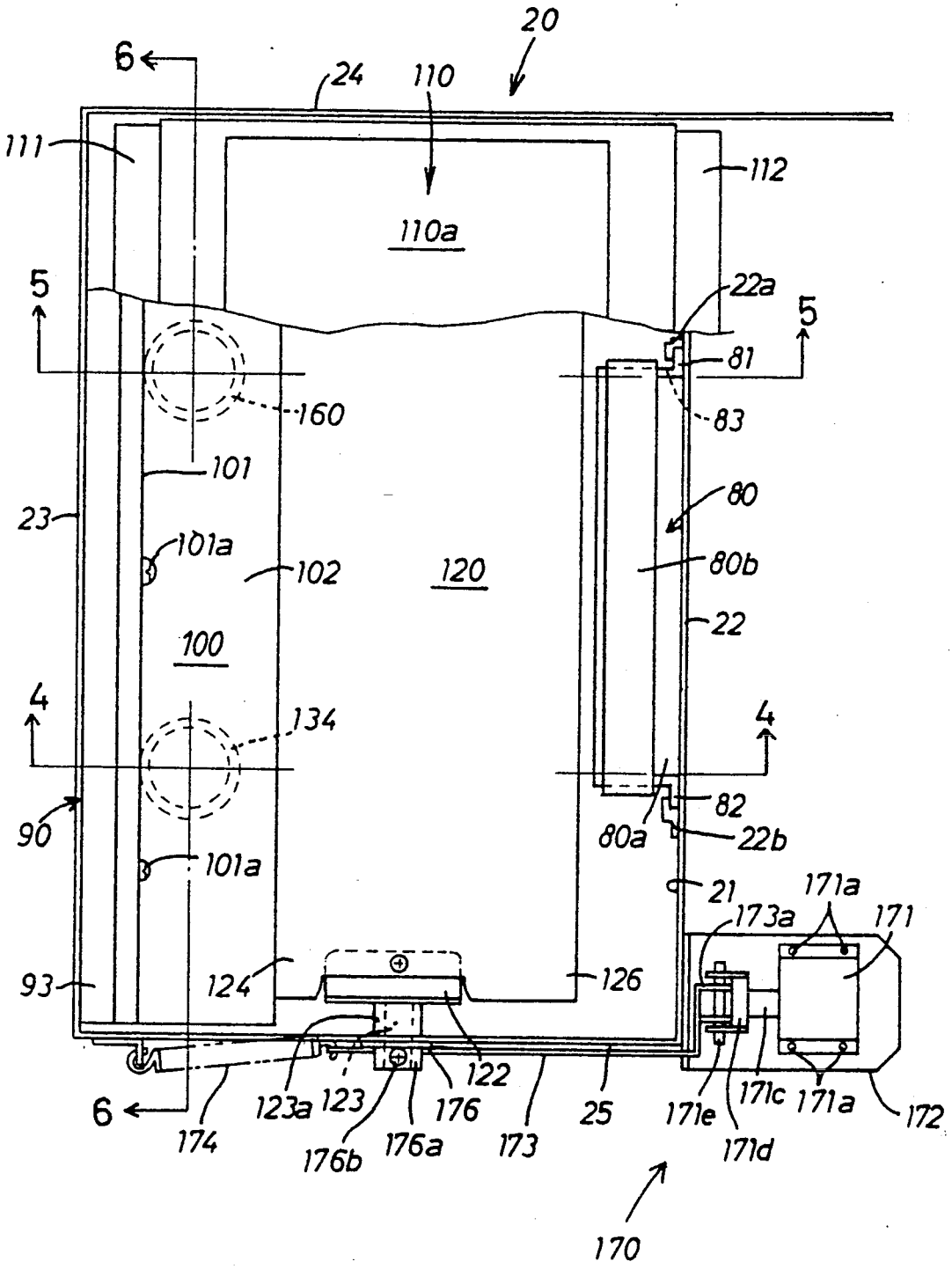
FIG. 3 is a partly broken plan view of a wash tank of the dishwashing machine.

In FIG. 1 of the drawings, there is schematically illustrated a dishwashing machine of the commercial spray-type which has a washing chamber 10 provided therein with a pair of upper and lower wash arms 11*a*, 11*b* and a pair of upper and lower rinse arms 12*a*, 12*b*. The wash and rinse arms 11*a*, 11*b* and 12*a*, 12*b* arranged to oppose dishes 14 in a rack 13 placed in the washing chamber 10. The washing chamber 10 has an inclined bottom wall provided at its left-hand portion with a wash tank 20 which opens at 21 into the interior of washing chamber 10 to store an amount of hot wash water therein. As shown in FIG. 3, the wash tank 20 has front and back walls 25, 24 and side walls 22, 23.

Figure 8:
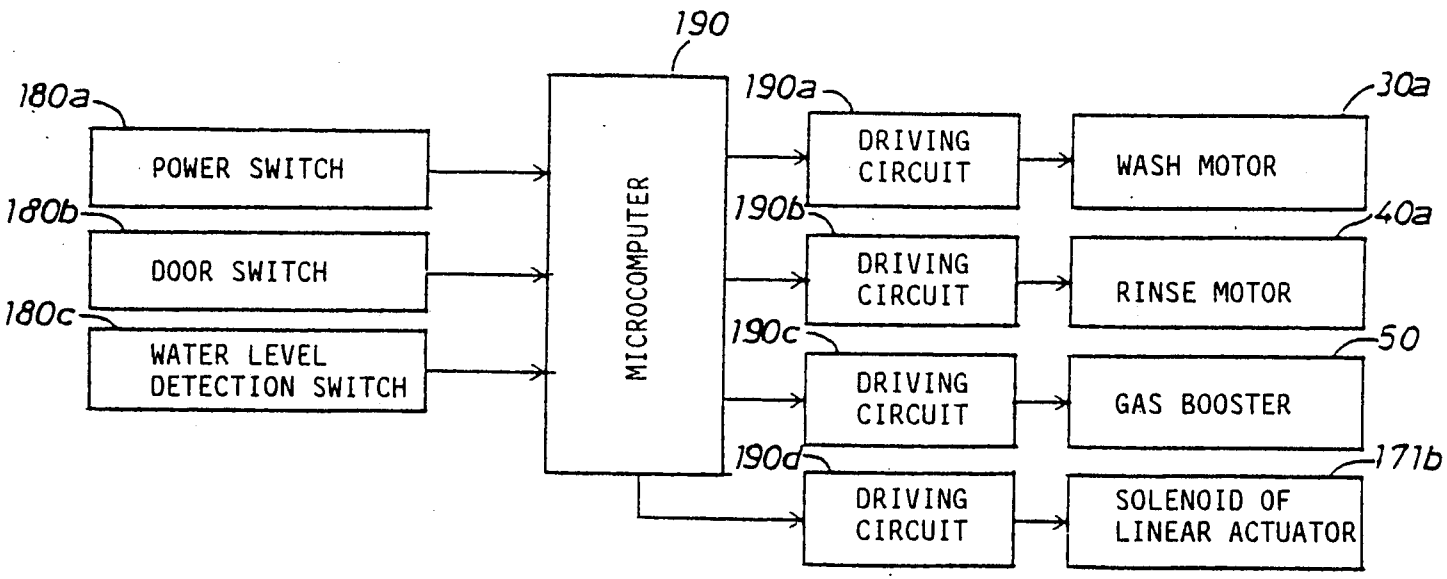
FIG. 8 is a block diagram of an electric control apparatus for the dishwashing machine shown in FIG. 1.

A wash pump 30 is connected to the right- and side wall 22 of tank 20 by means of a suction pipe 31 to be driven by an electric motor 30*a* shown in FIG. 8 in washing operation. The wash pump 30 acts in operation to draw the hot water from wash tank 20 through suction pipe 31 and supply it to the wash arms 11*a*, 11*b* through an upstanding conduit $P_1$. A rinse pump 40 is connected to a gas booster 50 by means of a conduit $P_2$ to be driven by an electric motor 40*a* shown in FIG. 8 in rinsing operation. The rinse pump 40 acts in operation to draw fresh hot water of predetermined temperature (for instance, 65 or 85 centigrade) from the gas booster 50 through conduit $P_2$ and supply it to the rinse arms 12*a*, 12*b* through an upstanding conduit $P_3$. The gas booster 50 is connected to a source of fresh hot water 60 by means of a conduit $P_4$ to be supplied with fresh hot water therefrom under control of a hot water supply valve 70 for heating the fresh hot water up to the predetermined temperature 65 or 85 centigrade.

Figure 2:
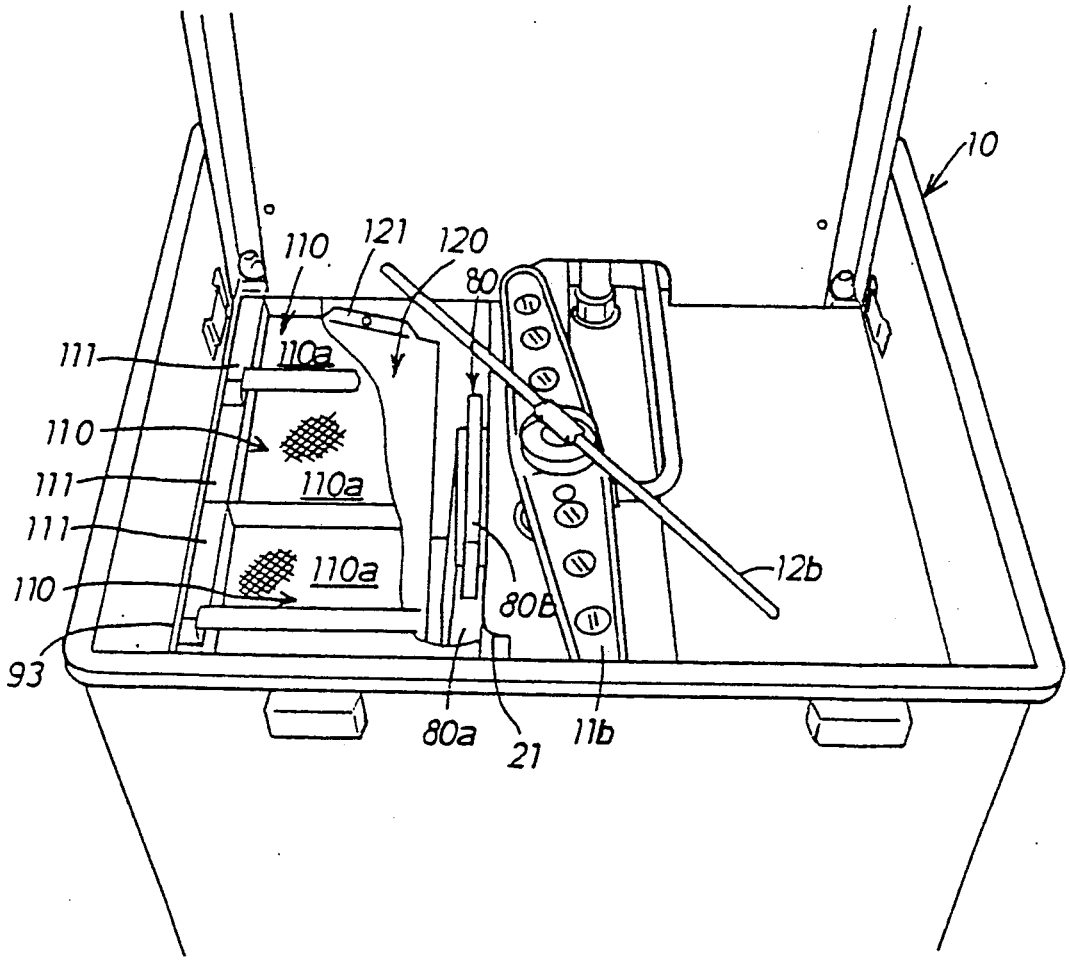
FIG. 2 is a perspective view showing an interior of the dishwashing machine.
Figure 4:
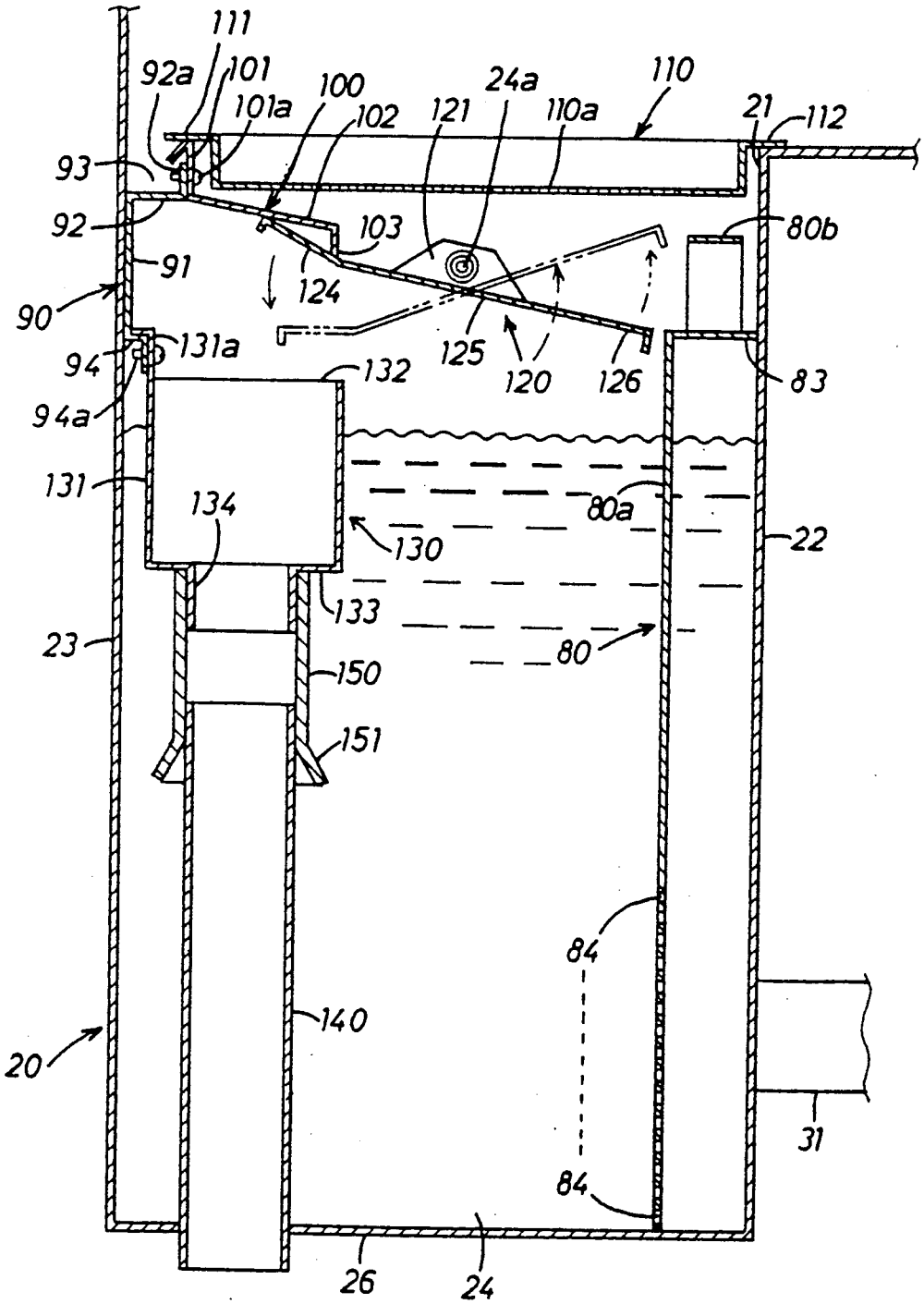
FIG. 4 is a vertical sectional view taken along line 4—4 in FIG. 3.

As shown in FIG. 2, a vertical filter 80 is removably assembled within the wash tank 20 to filter the wash water drawn into the wash pump 30 therethrough. As shown in FIGS. 3 and 4, the vertical filter 80 is in the form of a filter box 80*a* of rectangular in shape which is provided thereon with a grip member 80*b*. The filter box 80*a* has an open end 83 formed with a pair of vertical flanges 81 and 82 which are removably retained in place by means of metal fittings 22*a* and 22*b* secured to an internal surface of right-hand side wall 22 of tank 20. The filter box 80*a* has a front wall formed at its lower portion with a number of small holes 84 which are opposed to the suction pipe 31 in connection to the wash pump 30.

Figure 5:
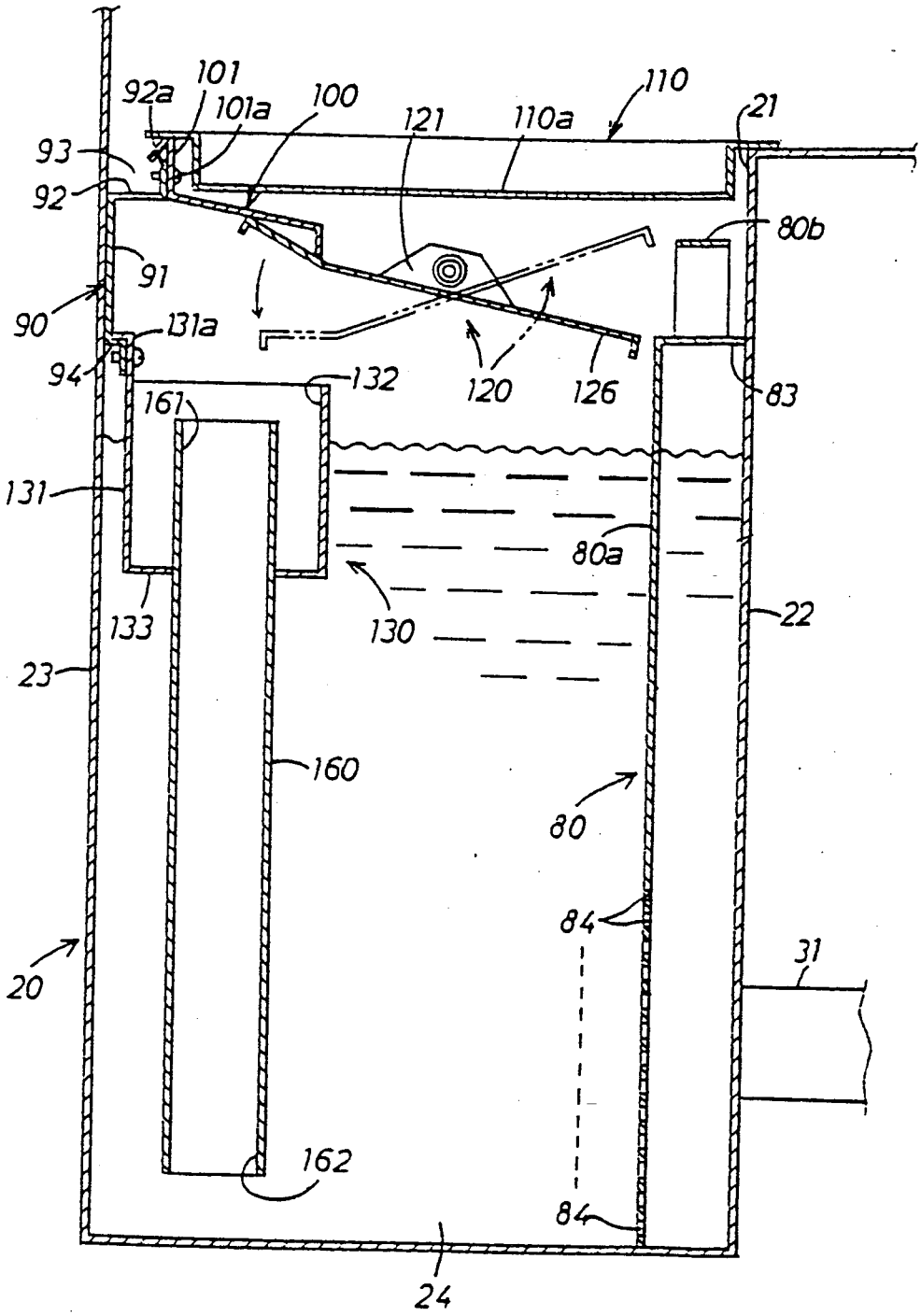
FIG. 5 is a vertical sectional view taken along line 5—5 in FIG. 3.

As shown in FIGS. 4 and 5, a horizontal support plate 90 is secured at its base portion 91 to an internal surface of left-hand side wall 23 of tank 20. As shown in FIG. 3, the horizontal support plate 90 extends transversely at an upper portion of tank 20 and is engaged at its opposite ends with internal surfaces of the front and back walls 25 and 24 of tank 20. As shown in FIG. 4, the support plate 90 has an upper flange 92 which is integrally formed with an upturned portion 92*a* to form a transverse trough 93 with the left-hand side wall 23 of tank 20. A transverse guide plate 100 is horizontally secured at its upturned portion 101 to the upturned portion 92*a* of support plate 92 by means of a plurality of screws 101*a*. The guide plate 100 has an downwardly inclined portion 102 extending from its upturned portion 101 toward an intermediate portion of tank 20 and is engaged at its opposite ends with the front and back walls 25 and 24 of tank 20, as shown in FIG. 3.

As shown in FIGS. 2 and 4, three scrap trays 110 are removably supported at their one ends 111 on the upturned portion 101 of guide plate 100 and at their other ends 112 on the upper end of right-hand side wall 22 of tank 20. The scrap trays 110 each are composed of an open top frame of rectangular in shape and a mesh filter 110*a* secured at its outer periphery to the bottom of the frame. As shown in FIGS. 3 and 4, a tiltable plate 120 of rectangular in shape is horizontally arranged just below the scrap trays 110 and located between the side walls 22 and 23 of tank 20 to cover an opening between the front and back walls 25 and 24 of tank 20. The tiltable plate 120 has a rear end flange 121 rotatably carried on the back wall 24 of tank 20 by means of a support shaft 24*a* and a front end flange 122 rotatably carried on the front wall 25 of tank 20 by means of a support shaft 123.

When rotated counterclockwisely and retained in a first position illustrated by imaginary lines in FIG. 4, the tiltable plate 120 receives hot water flowing down from the washing chamber 10 through the mesh filters 110*a* of strainer boxes 110 to introduce it into a rectangular drain box 130 described in detail later. When rotated clockwisely and retained in a second position illustrated by solid lines in FIG. 4, the tiltable plate 120 receives hot water flowing down from the washing chamber 10 through the scrap trays 110 to introduce it into the interior of tank 20 along the vertical filter 80. As clearly shown in FIG. 4, the tiltable plate 120 has a left-hand portion 124 upturned from a flat portion 125 of plate 120 and bent downward at its free end. In a condition where the tiltable plate 120 is retained in the second position, the left-hand portion 124 of plate 120 is maintained in engagement with the inclined portion 102 and bent portion 103 of guide plate 100 to restrict the upward reverse flow of hot water received by the flat portion 125 of plate 120.

Figure 6:
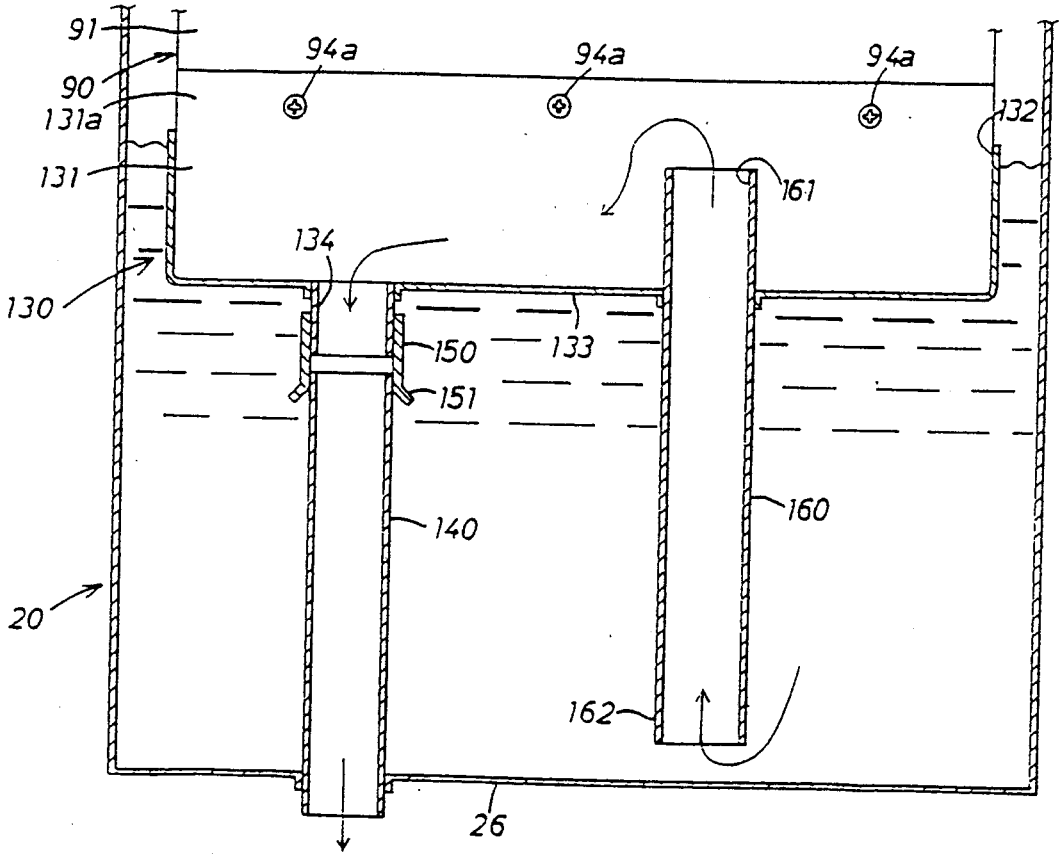
FIG. 6 is a vertical sectional view taken along line 6—6 in FIG. 3.

As shown in FIGS. 4–6, the rectangular drain box 130 is horizontally located just below the guide plate 100 and arranged along the left-hand side wall 23 of tank 20. The drain box 130 has a side wall 131 secured at its upper end 131*a* to the lower flange 94 of support plate 90 by means of screws 94*a* to support the drain box 130 in place. The upper end 132 of drain box 130 opens toward the left-hand portion 124 of tiltable plate 120 retained in the first position. As shown in FIG. 6, a pipe 134 is secured to the bottom wall 133 of drain box 130 for connection to an upstanding drain pipe 140 secured at its lower end to the bottom wall 26 of tank 20. The pipe 134 opens into the interior of drain box 130 at its upper end and is connected at its lower end to the upper end of drain pipe 140 by means of a cylindrical rubber coupling 150 to drain away contaminated hot water introduced into the drain box 130. An upstanding overflow pipe 160 is secured at its intermediate portion to the bottom wall 133 of drain box 130 to permit the upward flow of hot water from the bottom of tank 20 into the drain box 130. The drain pipe 160 extends upward into the interior of drain case in a predetermined distance to define the level of hot water stored in tank 20.

Figure 7:
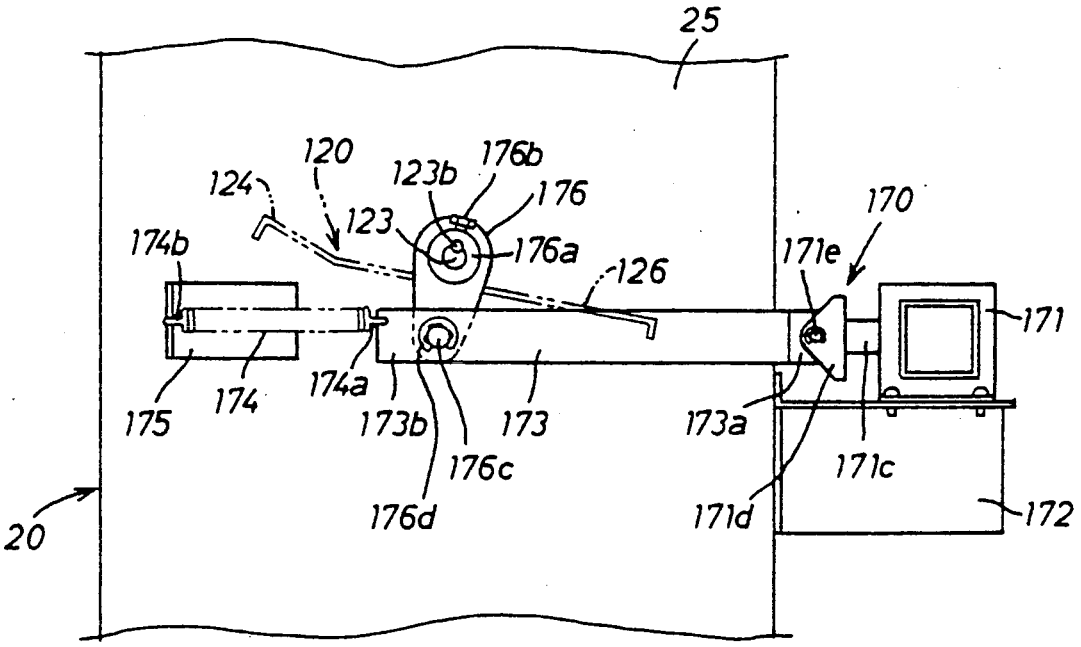
FIG. 7 is an elevation of a drive mechanism shown in FIG. 3.

As shown in FIG. 3, a drive mechanism 170 for the tiltable plate 120 is mounted to an upper portion of the right-hand side wall 22 of tank 20. The drive mechanism 170 includes a linear actuator 171 which is mounted on a bracket 172 secured to the right-hand side wall 22 of tank 20. The linear actuator 171 is secured in place to the bracket 172 by means of screws 171*a*. The linear actuator 171 is provided therein with a solenoid 171*b* shown in FIG. 8 and has a movable rod 171c which is retained in a position shown in the figure during deenergization of the solenoid 171b. When the solenoid 171b is energized, the movable rod 171c is attracted rightward in the figure. The movable rod 171c has a fork portion 171d linked with a fork portion 173a of a link lever 173 by means of a pin 171e. As shown in FIG. 7, the link lever 173 extends leftward along the front wall 25 of tank 20 and is connected at its left end 173b to one end 174a of a coil spring 174 which is engaged at its other end 174b with a bracket 175 secured to the front wall 25 of tank 20. The coil spring 174 acts to bias the link lever 173 leftward when pulled by attraction of the movable rod 171c. A rotary lever 176 is fixed at its annular boss 176a to the support shaft 123 of tiltable plate 120 through a key 123b by means of a screw 176b for rotation therewith. The rotary lever 176 is rotatably connected to the link lever 173 by means of a pin 176c secured thereto and retained in place by a circlip 176d. When the link lever 173 is moved rightward by attraction of the movable rod 171c, the rotary lever 176 is rotated counterclockwisely to rotate the tiltable plate 120 toward the first position.

In FIG. 8, there is illustrated an electric control apparatus for the dishwashing machine which includes a microcomputer 190 connected to a power switch 180a, a door switch 180b and a water level detection switch 180c. The power switch 180a is arranged to activate the computer 190 when it has been operated. The door switch 180b is in the form of a normally open switch which is closed when a door of washing chamber 10 has been closed. The water level detection switch 180c is in the form of a normally open switch which is closed when the wash tank 20 has been fully filled with hot wash or rinse water. The computer 190 is arranged to cooperate with the door switch 180b and water level detection switch 180c to execute a control program for driving circuits 190a–190d of wash motor 30a, rinse motor 40a, gas booster 50 and solenoid 171b. The control program is memorized in a read-only memory or ROM of computer 190. When activated by operation of the power switch 180a, the computer 190 will initiate the execution of the control program as described in detail below.

Figure 9A:
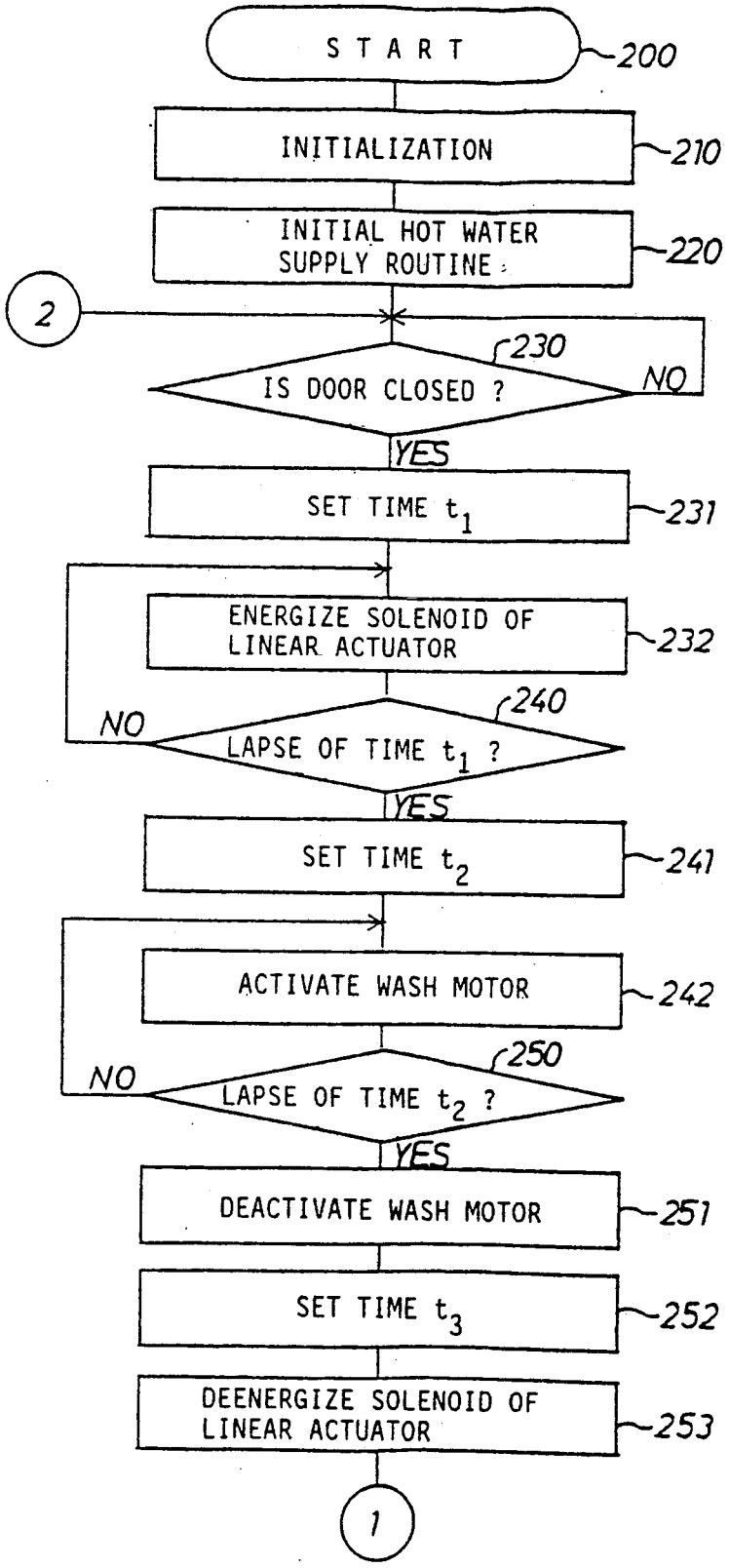
FIGS. 9 (*a*) and (*b*) illustrate a flow chart of a control program executed by a microcomputer shown in FIG. 8.
Figure 9B:
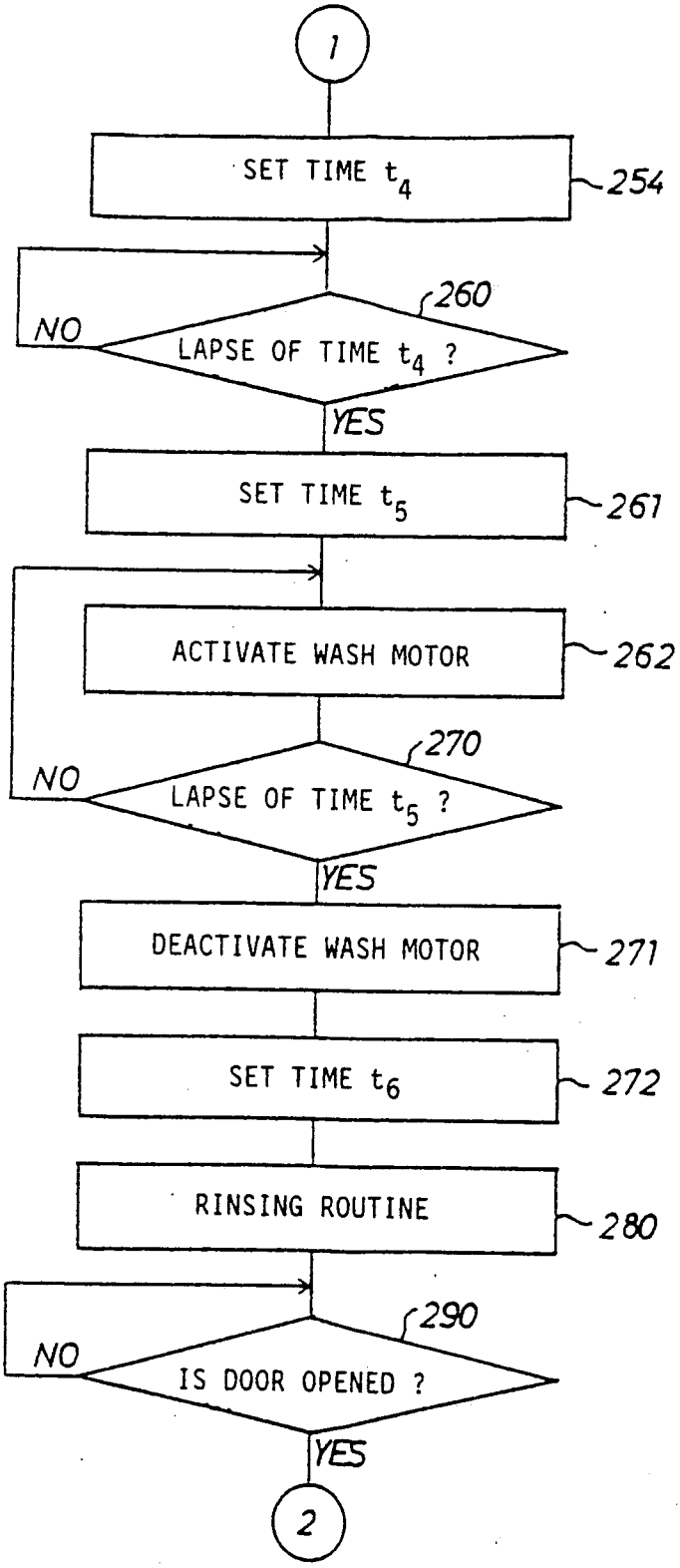

In FIGS. 9 (*a*) and (*b*), the control program is illustrated in the form of a flow chart. When activated by operation of the power switch 180a to initiate the execution of the control program at step 200, the computer 190 is initialized at step 210 and causes the program to proceed to step 220 for executing an initial hot water supply routine. At step 220, the computer 190 energizes the driving circuit 190c to activate the gas booster 50. Thus, the hot water in gas booster 50 is heated up to about 65 centigrade and maintained at the heated temperature. The computer 190 further energizes the driving circuit 190b to activate the rinse motor 40a. Thus, the rinse pump 40 is driven by rinse motor 40a to draw the hot water from gas booster 50 and supply it to the rinse arms 12a, 12b through conduits $P_2$ and $P_3$ in a condition where the tiltable plate 120 is retained in the second position. In the washing chamber 10, the hot water is sprayed as jet streams by rotation of the rinse arms 12a, 12b and falls on the guide plate 100 and tiltable plate 120 through the scrap trays 110. In this instance, the guide plate 100 and tiltable plate 120 introduce the hot water into the wash tank 20. When the wash tank 20 is fully filled with the hot water, the water level detection switch 180c is closed, and the computer 190 deenergizes the driving circuit 190b in response to an electric signal applied thereto from the detection switch 180c to deactivate the rinse motor 40a to stop the rinse pump 40. In such a condition, the gas booster 50 is activated under control of the computer 190 to heat the hot water up to about 85 centigrade and maintain it at the heated temperature.

Assuming that soiled dishes 14 are placed on the rack 13 in the above-described condition, the computer 190 is applied with a electric signal from the door switch 180b when the door of washing chamber 10 has been closed. Thus, the computer 190 determines a "Yes" answer at step 230 and causes the program to step 231 where the computer 190 resets and starts a timer provided therein to calculate a first predetermined period of time $t_1$. At the following step 232, the computer 190 energizes the driving circuit 190d to energize the solenoid 171b of linear actuator 171. Thus, the movable rod 171c of linear actuator 171 is attracted by energization of the solenoid 171b to move the link lever 173 rightward, and in turn, the rotary lever 176 is rotated counterclockwisely to rotate the tiltable plate 120 toward the first position. When the tiltable plate 120 is retained in the first position after lapse of the first predetermined period of time $t_1$, the computer 190 determines a "Yes" answer at step 240 and causes the program to step 241 where the computer 190 resets and starts the timer to calculate a second predetermined period of time $t_2$. At the following step 242, the computer 190 energizes the driving circuit 190a to activate the wash motor 30a. Thus, the wash pump 30 is driven by energization of the wash motor 30a to pump up the hot water from wash tank 20 and supply it to the wash arms 11a, 11b through conduit $P_1$. During calculation of the second predetermined period of time $t_2$, the racked dishes are prewashed by jet streams of the hot water supplied to the wash arms 11a, 11b. In this instance, food scraps released from the dishes are received by the scrap trays 110, while all the soiled wash water is received by the guide plate 100 and tiltable plate 120 and flows into the drain box 130. Thus, the soiled wash water is drained from the drain box 130 through the drain pipe 140 to cleanly maintain the remaining hot wash water in tank 20 without causing fall of its temperature.

Upon lapse of the second predetermined period of time $t_2$, the computer 190 determines a "Yes" answer at step 250 and causes the program to proceed to step 251 where the computer 190 deenergizes the wash motor 30a to finish prewash of the racked dishes. At the following step 252, the computer 190 maintains the driving circuit 190d of solenoid 171b in its energized condition for a third predetermined period of time $t_3$ during which the soiled wash water flowing down from the racked dishes is completely introduced into the drain box 130 by means of the tiltable plate 120 in the first position. After lapse of the third predetermined period of time $t_3$, the program proceeds to step 253 where the computer 190 deenergizes the driving circuit 190d of solenoid 171b at step 253 and causes the program to proceed to step 254 shown in FIG. 9 (*b*). At step 254, the computer 190 resets and starts the timer to calculate a fourth predetermined period of time $t_4$. When the solenoid 171b of linear actuator 171 is deenergized at step 253, the movable rod 171c is moved leftward by the biasing force of coil spring 174 to rotate the tiltable plate 120 clockwisely. When the tiltable plate 120 is retained in the second position after lapse of the fourth predetermined period of time $t_4$, the computer 190 determines a "Yes"

answer at step 260 and causes the program to proceed to step 261 where the computer 190 resets and starts the timer to calculate a fifth predetermined period of time $t_5$. At the following step 262, the computer 190 energizes the driving circuit 190*a* of wash motor 30*a* to activate the wash pump 30. Thus, the remaining hot wash water is pumped up by the wash pump 30 and supplied to the wash arms 11*a*, 11*b* through conduit $P_1$ During calculation of the fifth predetermined period of time $t_5$, the racked dishes are washed by jet streams of the hot wash water supplied to the wash arms 11*a*, 11*b*. In this instance, the wash water flowing down from the racked dishes is received by the tiltable plate 120 and introduced into the wash tank 20 to be recirculated by the wash pump 30, while food scraps released from the dishes are received by the scrap trays 110.

Upon lapse of the fifth predetermined period of time $t_5$, the computer 190 determines a "Yes" answer at step 270 and causes the program to proceed to step 271 where the computer 190 deenergizes the wash motor 30*a* to finish the washing operation. At the following step 272, the computer 190 maintains the driving circuits 190*a*, 190*b* and 190*d* in their deenergized conditions for a sixth predetermped period of time $t_6$. After lapse of the period of time $t_6$, the program proceeds to step 280 where the computer 190 energizes the driving circuit 190*b* of rinse motor 40*a* for a predetermined period of time. Thus, the rinse pump 40 is driven by activation of the rinse motor 40*a* to pump up the fresh hot rinse water of about 85 centigrade from the gas booster 50 and supply it to the rinse arms 12*a*, 12*b* through conduits $P_2$, $P_3$ for rinsing the racked dishes. During such rinsing operation, the hot rinse water flowing down from the racked dishes is received by the tiltable plate 120 in the second position and introduced into the wash tank 20. When the wash tank 20 is filled with the hot rinse water introduced by the tiltable plate 120, the hot water of low temperature is lifted into the drain box 130 from the bottom of tank 20 through the overflow pipe 160 and drained through the drain pipe 140. As a result, the hot water in tank 20 is maintained at a proper high temperature required for proper cleaning and sanitizing the dishes. When the rinsing operation has finished, the computer 190 deenergizes the driving circuit 190*b* of rinse motor 40*a* and determines at step 290 as to whether the door of washing chamber 10 has been opened or not. If the answer is "Yes" at step 290, the program returns to step 230.

Having now fully set forth both structure and operation of a preferred embodiment of the concept underlying the present invention, various other embodiments as well as certain variations and modifications of the embodiment shown and described herein will obviously occur to those skilled in the art upon becoming familiar with said underlying concept. It is to be understood, therefore, that within the scope of the appended claims, the invention may be practiced otherwise than as specifically set forth herein.

What is claimed is:

1. A dishwashing machine including a washing chamber having a bottom, a vertical wash tank provided at the bottom of said washing chamber to store an amount of hot wash water therein, a wash pump mounted to a bottom portion of said wash tank to pump up the hot wash water therefrom, first spray means for applying jet streams of the hot wash water supplied thereto from said wash pump over a rack of dishes placed in said washing chamber, a rinse pump arranged to pump up fresh hot water supplied thereto from a source of hot water, and second spray means for applying jet streams of the fresh hot water supplied thereto from said rinse pump over the rack of dishes placed in said washing chamber, wherein said dishwashing machine comprises a drain box arranged within an upper portion of said wash tank to receive the wash water flowing down from the rack of dishes and associated with a side wall of said wash tank to form an opening in communication with the bottom portion of said wash tank; an upstanding drain pipe connected to a bottom wall of said drain box and being extended outwardly through the bottom wall of said wash tank to drain therethrough the wash water received by said drain box; an upstanding overflow pipe secured at its intermediate portion to the bottom wall of said drain box to permit the upward flow of wash water from the bottom of said wash tank into said drain box, said overflow pipe extending upward into the interior of said drain box in a predetermined distance to define the level of wash water stored in said wash tank; a tiltable plate arranged above said drain box to introduce the wash water flowing down from the rack of dishes into said drain box when placed in a first position and to introduce the wash water or fresh hot water flowing down from the rack of dishes into the bottom portion of said wash tank through said opening when placed in a second position; and a drive mechanism for placing said tiltable plate in the first position when the rack of dishes is prewashed by jet streams of the wash water applied from said first spray means and for placing said tiltable plate in the second position when the rack of dishes is washed by jet streams of the wash water applied from said first spray means after prewashing operation and is rinsed by the fresh hot water applied from said second spray means.

2. A dishwashing machine as claimed in claim 1, wherein a scrap tray is removably arranged above said tiltable plate to filter the wash water flowing down from the rack of dishes in the prewashing and washing operations.

3. A dishwashing machine as claimed in claim 1, wherein said drain box is located just below a guide plate mounted to a side wall of said wash tank to receive the wash water flowing down from the rack of dishes and introduce it toward said tiltable plate.

* * * * *